United States Patent [19]

Srinivasan et al.

[11] 4,340,449

[45] Jul. 20, 1982

[54] METHOD FOR SELECTIVELY ELECTROPLATING PORTIONS OF ARTICLES

[75] Inventors: Venkataraman Srinivasan, Attleboro; Stephen Cassidy, Canton; Charles Grassie, Attleboro, all of Mass.

[73] Assignee: Texas Instruments Incorporated, Dallas, Tex.

[21] Appl. No.: 197,445

[22] Filed: Oct. 16, 1980

Related U.S. Application Data

[63] Continuation of Ser. No. 840,698, Oct. 11, 1977, abandoned.

[51] Int. Cl.[3] ..... C25D 5/02; C25D 5/08

[52] U.S. Cl. ..... 204/15; 204/224 R

[58] Field of Search ..... 204/15, 224 R

[56] References Cited

U.S. PATENT DOCUMENTS

| | | | |
|---|---|---|---|
| 3,723,283 | 3/1973 | Johnson | 204/206 |
| 3,963,588 | 6/1976 | Glenn | 204/224 R |
| 4,001,039 | 1/1977 | Koontz | 204/15 |
| 4,003,805 | 1/1977 | Schaer | 204/27 |
| 4,029,555 | 6/1977 | Tezuka | 204/15 |
| 4,030,999 | 6/1977 | Allen | 204/15 |
| 4,033,833 | 7/1977 | Bestel | 204/15 |
| 4,033,844 | 7/1977 | Pantiga | 204/15 |

*Primary Examiner*—T. Tufariello

*Attorney, Agent, or Firm*—James P. McAndrews; John A. Haug; Melvin Sharp

[57] ABSTRACT

A plurality of articles are advanced in continuous sequence in spaced relation to each other through an electroplating bath to pass in sliding engagement with a pair of lands, thereby to move selected, laterally-extending strips of the articles along an anode surface located between the lands in selected, closely spaced, facing relation to the anode surface. Jets of the electroplating solution are directed through a plurality of openings in the anode surface to provide a continuous positive flow of electroplating solution in a direction from the anode surface against the selected strips of the articles moving past the anode surface and to permit the flow of electroplating solution to pass between the articles while the lands substantially restrict the flow of the electroplating solution in other directions. Electrical current is directed through the flowing electroplating solution between the anode surface and the article strips for plating the selected article strips to a desired thickness.

1 Claim, 6 Drawing Figures

METHOD FOR SELECTIVELY ELECTROPLATING PORTIONS OF ARTICLES

This is a continuation of application Ser. No. 840,698, filed Oct. 11, 1977, now abandoned.

In providing electrical contact members formed of spring materials and the like, it is desirable to plate the members with a precious metal such as gold to improve the contact surface resistance properties of the members. Because of the high cost of the plating material, it is desirable to apply the gold plating only to those portions of the members which are to be actually engaged with a mating contact during opening and closing of a circuit, thereby to restrict the quantity of gold which is used. However, to achieve competitive pricing for such contact members, it is also necessary to manufacture the members with low unit manufacturing costs whether those costs constitute material costs or processing costs. Various methods and apparatus have been developed for selectively electroplating portions of the contact members and the like in attempting to reduce the amount of precious metal which is plated on the members. Frequently, however, the techniques which have been used in such selective electroplating have failed to achieve satisfactory savings in the amount of gold which is used or have involved processing costs which have tended to cancel out some of the material cost savings resulting from the selective electroplating. For example, some of the techniques used have involved intermittent advancing and individual masking of precisely predetermined portions of the articles to be plated and have involved excessive processing costs. Other techniques for selective plating have resulted in significant variation in the thickness of the plating formed on the members so that, when adequate tolerances have been provided to assure that the necessary minimum plating thicknesses are formed on selected parts of the articles to meet desired specifications, a substantial part of the material savings intended to be achieved by the selecting plating have been lost.

It is an object of this invention to provide novel and improved methods and apparatus for selectively electroplating articles; to provide such methods and apparatus which are particularly adapted for electroplating at least a selected thickness of precious metal on selected laterally extending strips of a plurality of articles in a convenient and economical manner; to provide such methods and apparatus which are adapted to be employed with a high degree of uniformity and control for permitting use of relatively small thickness tolerances during such plating; and to provide such methods and apparatus which are adapted for use in selectively electroplating electrical contact members and the like with low unit processing costs.

Briefly described, the novel and improved apparatus of this invention comprises a container for an electroplating bath, an anode having a longitudinally extending surface disposed in the bath and lands of electrically insulating material which extend longitudinally along the lateral edges of the anode surface. Means advance a plurality of articles in continuous sequence in spaced relation to each other so that portions of the articles including selected laterally extending strips of the articles are moved through the bath in sliding engagement with the lands, thereby to pass each of the selected laterally extending strips of the articles in closely spaced facing relation to the anode surface along the length of the anode surface. The anode and lands are preferably mounted on a conduit which extends through the electroplating bath. The conduit and anode have a plurality of openings therein and pump means direct electroplating solution into the conduit, whereby jets of the solution are directed through the openings to establish a continuous positive flow of the electroplating solution in a direction from the noted anode surface against the selected laterally extending strips of the articles moving past the anode surface and to permit the flow of the solution to pass between the articles being advanced while the lands substantially restrict the flow of the electroplating solution in other directions. Means direct electrical current through the flowing electroplating solution between all parts of the anode surface and the selected strips of the articles moving past the anode surface for electroplating the article strips. Preferably the anode surface has a configuration corresponding to that of the selected laterally extending strips of the articles moved past the anode surface so that each portion of each of the selected article strips is moved in the desired spaced relation to a corresponding portion of the anode surface.

In this arrangement, the close spacing of the article strips to the anode surface as the strips are moved past the anode surface, and the maintenance of a continuous positive flow of the electroplating solution in the small space between the anode surface and the article strips moving past the anode surface, achieve rapid uniform plating of the article strips to the desired thickness without requiring excessive thickness tolerances such as would tend to waste the precious plating metal. On the other hand, the sliding engagement of the articles with the lands substantially restricts electroplating of other portions of the articles so that the selected laterally extending strips of the articles moving between the lands are plated in a substantially selective manner without resulting in plating of other portions of the articles to any excessive extent such as would tend to waste any excessive proportion of the plating metal. In this way, the combined benefits of low processing cost and limited use of the expensive plating material achieves the desired product quality with improved low unit manufacturing costs.

Other objects, advantages and details of the novel and improved methods and apparatus of this invention appear in the following detailed description of preferred embodiments of the invention, the detailed description referring to the drawings in which.

Figure 1:
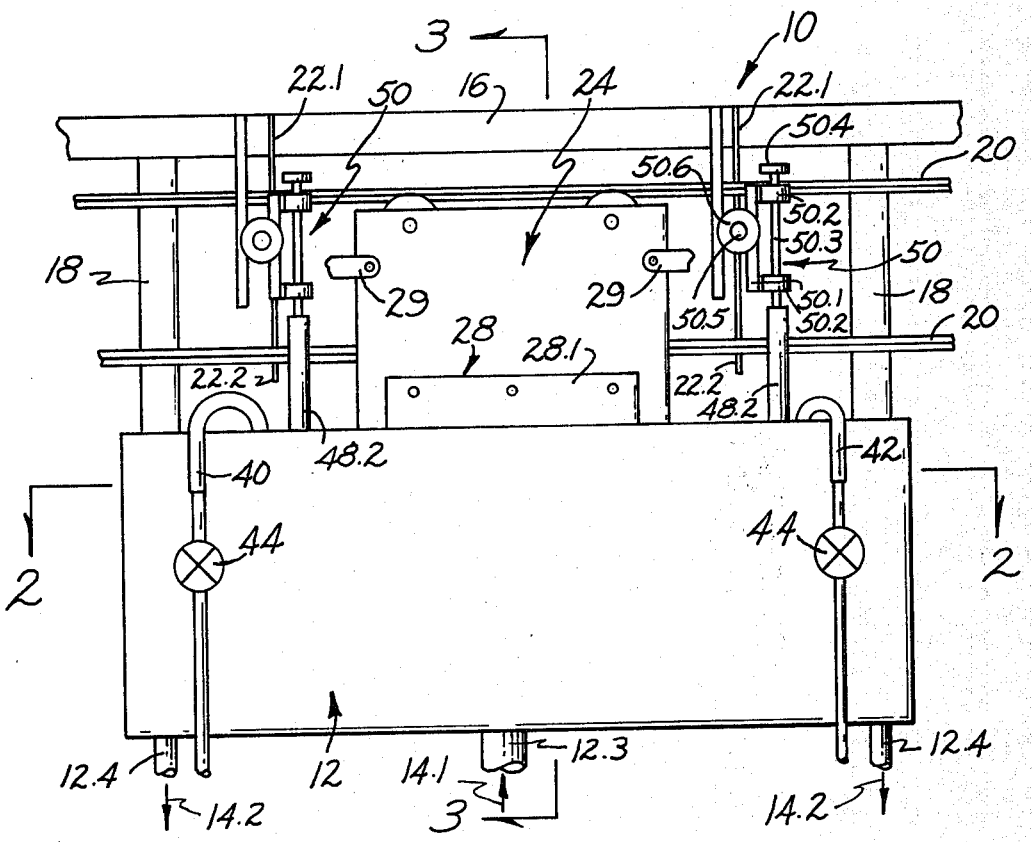
FIG. 1 is a front elevation view of the apparatus of this invention.
Figure 2:
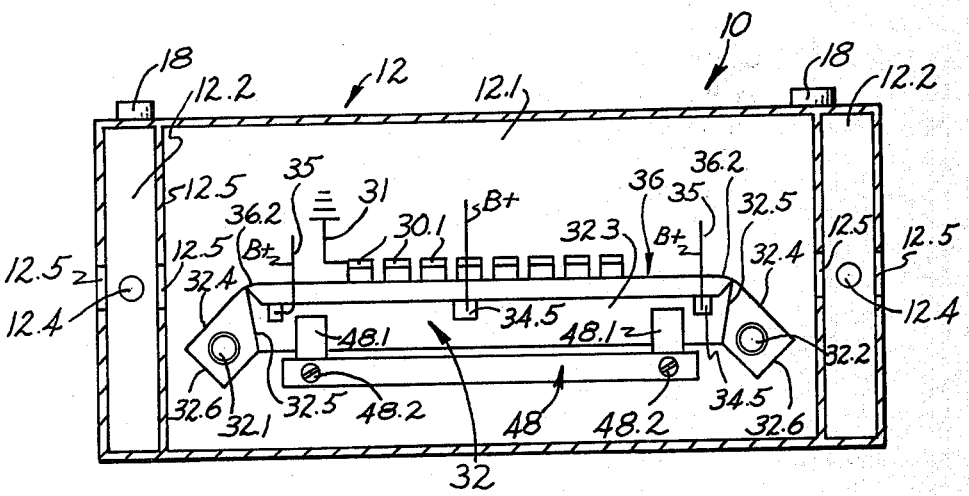
FIG. 2 is section view along line 2—2 of FIG. 1.
Figure 3:
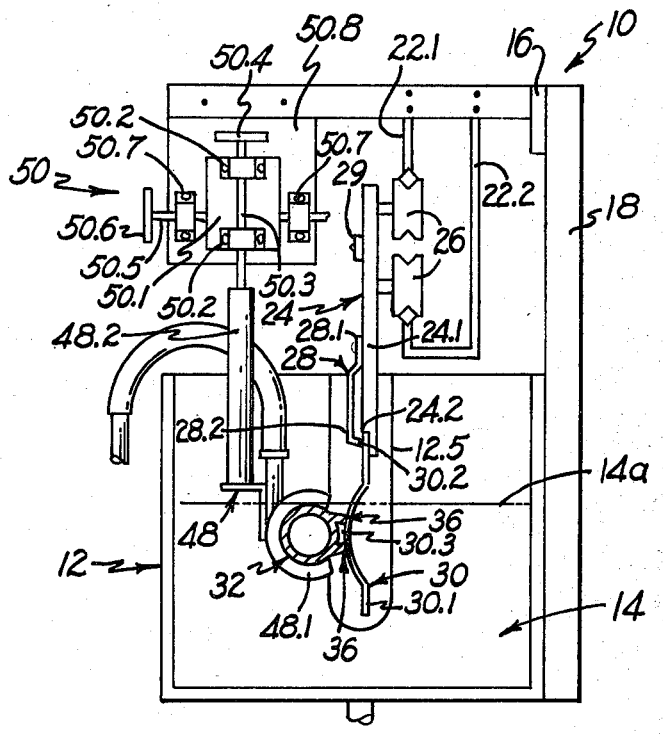
FIG. 3 is a section view along line 3—3 of FIG. 1.

Referring to the drawings, 10 in FIGS. 1–3 indicates the novel and improved electroplating apparatus of this invention which is shown to include a tank or container 12 for a bath of an electroplating solution 14. The container is mounted on a frame 16 by supporting brackets 18 and is preferably divided into a central bath compartment 12.1 and overflow compartments 12.2, the overflow compartments being located at opposite ends of the central compartment as is best seen in FIG. 2. An inlet conduit 12.3 is preferably arranged to introduce electroplating solution into the central bath compartment 12.1 from a reservoir (not shown) as is diagrammatically indicated in FIGS. 1 and 3 by the arrow 14.1 while outlet conduits 12.4 from the overflow compartments return electroplating solution to the reservoir as is indicated by the arrows 14.2 in FIG. 1. The ends of the container 12 and the walls separating the container compartments are preferably provided with aligned wier-like slots 12.5. In this arrangement, the bath 14 of electroplating solution is maintained at a selected depth as indicated at 14*a* in FIG. 3 by the continuous introduction of the solution into the central container compartment 12.1 through the inlet conduit 12.3, and by other means further described below, while the electroplating solution is also permitted to flow from the central bath compartment 12.1 into the overflow compartments 12.2 through the wier-like slots 12.5 for return to the reservoir through the conduits 12.4. If desired, additional wier means of any conventional type are employed along the other sides of the central bath compartment for assisting in regulation of the depth of the electroplating bath 14.

The frame 16 additionally mounts two work carrier rails 30 by means of supporting brackets 22.1 and 22.2 and a plurality of work carriers 24 (only one of which is shown) are each provided with a plurality of grooved rollers 26 disposed in rolling engagement with the rails 20 as is best shown in FIGS. 1 and 3, whereby the work carriers are movable along the rails to pass along a selected path relative to the electroplating bath 14. Typically, for example, the work carriers are interconnected by links 29 or the like as partially shown in FIGS. 1 and 3, whereby the carriers are adapted to be advanced by any conventional means (not shown) in continuous sequence relative to the bath 14. Preferably each carrier includes a main plate 24.1 having a work-locating shoulder 24.2 and has a spring clamp 28 with one end 28.1 secured to the main plate, the clamp having its opposite end 28.2 resiliently engaging a work piece 30 for detachably holding the work piece in selected position on the carrier in electrically connected relation to the carrier. The carriers 24 or the work pieces 30 themselves are connected to electrical ground in any conventional manner as is diagrammatically illustrated at 31 in FIG. 2.

Figure 5:
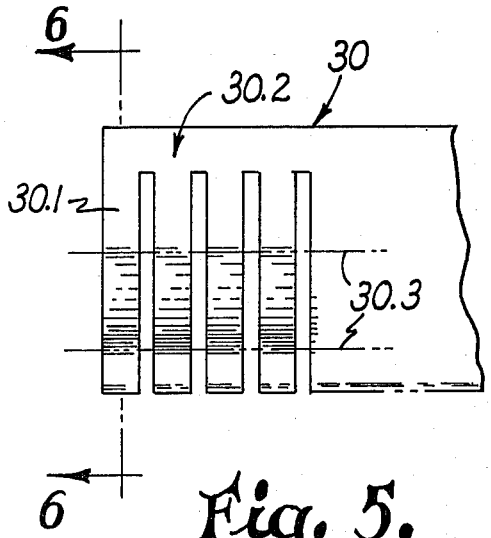
FIG. 5 is a front elevation view of an article having a plurality of electrical contact members illustrating the plating of selected laterally extending strips of the members in accordance with this invention.

The work piece or article 30 typically comprises a group of electrical contact members 30.1 (see FIG. 5) which are secured in selected spaced relation to each other by an integral web 30.2 of the same material, usually a beryllium copper material or the like. The work piece is inserted into the carrier 24 to abut the web 30.2 with the carrier shoulder 24.2 and the clamp is engaged with the web to locate the contact members is precisely predetermined position depending from the carrier. In this arrangement, by selected control of the depth of the bath 14, the carriers advance the contact members 30.1 through the wier-like slots 12.5 in the ends and separating walls of the tank 12 into and through the plating bath 14 so that a selected portion of each contact member is immersed in the bath for a selected period of time as determined by the speed of advance of the carriers and by the length of the central bath compartment 12.1. In this way, the immersed portions of the contact members are passed through the bath in continuous sequence in selected spaced relation to each other to be selectively electroplated as is hereinafter described. If desired, the individual contact members 30.1, or selected groups of the contact members, are separated from the web 30.2 after each electroplating. Alternately of course, smaller groups of the contact members, or even separate individual contact members or other articles are mounted in selected side-by-side spaced relation to each other in each of the work carriers to be passed through the bath 14 in the manner described. Of course, any other conventional means can also be employed in accordance with this invention for moving articles to be plated such as the contact members 30.1 through the bath 14 in the described spaced, sequential relation.

In accordance with this invention, a conduit 32, preferably formed of a chemical-resistant, heat-resistant electrically insulating material such as a vinyl chloride copolymer or the like is positioned within the electroplating bath 14, the conduit being provided with inlets 32.1 32.2 at its opposite ends as is best shown in FIG. 2. Preferably for example, the conduit includes a central, longitudinally extending tube portion 32.3 which is bonded or otherwise secured to two end tube portions 32.4 along oblique lines of intersection 32.5 as shown in FIG. 2, the outer ends 32.6 of the end tube portions shown in FIG. 2, the outer ends 32.6 of the end tube portions being closed with a plug or the like for a purpose hereinafter described.

Figure 4:
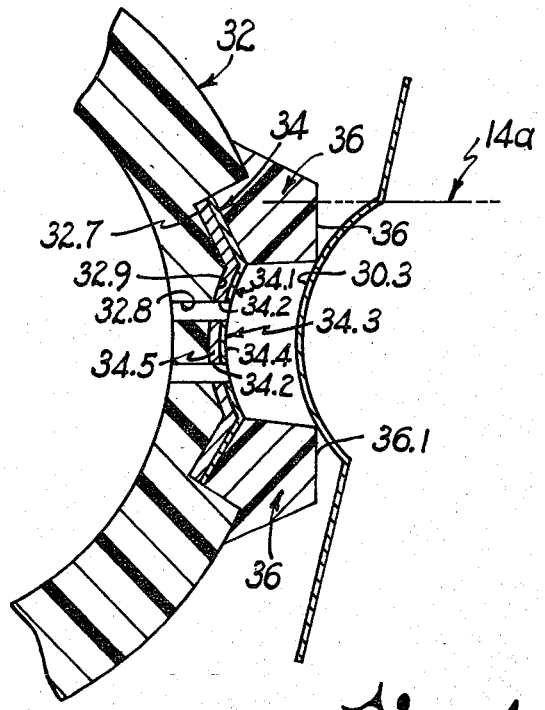
FIG. 4 is partial section view to enlarged scale similar to FIG. 3.

In accordance with this invention, the central tube 32.3 has a groove 32.7 therein extending longitudinally along substantially the entire length of the central tube part 32.3. See FIGS. 4 and 6. The central tube also has a plurality of openings 32.8 communicating between the interior of the tube and the groove 32.7. Typically, for example, the central tube 32.3 has a length of about 40 inches, as interior diameter of about 1.0 inches, and a wall thickness of about 3/16 inches while the groove 32.7 is about 0.5 inches wide and extends along the length of the central tube. The groove preferably has a central part 32.9 of a selected arcuate configuration or the like and has two lateral parts flared outwardly from the central part as shown in FIG. 4. Pairs of the openings 32.8 of about 1/32 inch diameter are then equally spaced about 1.0 inch apart along the length of the groove 32.7 in the central part of 32.9 of the groove.

In accordance with this invention, an anode 34 is positioned within the groove 32.7 to extend longitudinally along the length of the groove, the anode also preferably having a center part 34.1 of a selected arcuate surface configuration or the like conformed to the center part 32.9 of the groove and has flared lateral parts conformed to the flared lateral parts of the groove. The anode also has openings 34.2 therein located in registry with the respective conduit openings 32.8, the anode openings extending through the center part of anode through the anode surface 34.3. Preferably the anode has a thin layer of platinum or the like 34.4 on the anode surface 34.3 while the greater part of the anode is formed of a layer of columbium or the like, the outer layer material 34.4 being selected with respect to the gold or other material to be plated while the material of the remainder of the anode is selected for its lower cost, for its electrical conductivity, and for its resistance to corrosion and the like during immersion in the electroplating bath 14. Typically, the anode is provided with leads 34.5 (see FIG. 2) which are electrically connected to a power source in any conventional manner as is diagrammatically illustrated at 35 in FIG. 2, the leads 34.5 and the electrical connection to the leads preferably being electrically insulated from the bath 14 in any conventional manner.

In accordance with this invention, a pair of lands 36 of electrical insulating material are disposed along the lateral edges of the center part 34.1 of the anode in upstanding relation to the anode surface 34.3, whereby the outer edges 36.1 of the lands are precisely spaced from the anode surface 34.3. Preferably, as shown in FIGS. 3 and 4, the lands are formed of the same material as the conduit 32 and are bonded or otherwise secured in any conventional manner to the central tube 32.3 of the conduit and to the anode to extend over the lateral parts of the anode for securing the anode to the conduit 12. Preferably, as is best shown in FIG. 2, the ends 36.2 of the lands are tapered down for a purpose to be described below.

The conduit 32 as above described is connected by means of flexible tubes 40 and 42 to the previously described reservoir of electroplating solution (not shown) and conventional pump means 44 are interposed in the tubes 40 and 42 for circulating electroplating solution from the reservoir into the conduit to be directed in a series of jets or streams 46 through the openings 32.8 and 34.2 in the conduit and anode (as indicated at 46 in FIGS. 4 and 6) into the electroplating bath 14. Preferably the pump is selected to direct a sufficient flow into the conduit to achieve substantially uniform flow of the jets or streams 46 from the various openings 32.8 and 34.2 along the length of the conduit and anode as will be understood.

In accordance with this invention, the conduit 32 is positioned within the bath 14, preferably by adjustable support means, so that the contact member 30.1 or the articles carried by the work carriers 24 are resiliently engaged with the lands 36 on the conduit as the articles are advanced in sequence through the bath 14. Typically for example the conduit is mounted on a support bracket 48 by means of clamps 48.1 while the bracket is suspended on support rods 48.2 from an adjusting mechanism 50 secured to the frame 16. The adjusting mechanism includes a first plate 50.1 having bosses 50.2 thereon which are threadedly engaged with studs 50.3, the studs also being threaded into the support rods 48.2 and being rotatable by control knobs 50.4. The first plate is mounted on a second threaded stud 50.5 which is rotatable by a knob 50.6 to be advanced in bosses 50.7 on a second plate 50.8 secured to the frame 16. In this arrangement, rotation of the control knobs 50.4 and 50.6 adjusts the location of the conduit 32 relative to the path of the contact members 30.1 through the bath as will be understood. Alternately, of course, any other conventional means are used for supporting the conduit 32 in the bath 14.

Figure 6:
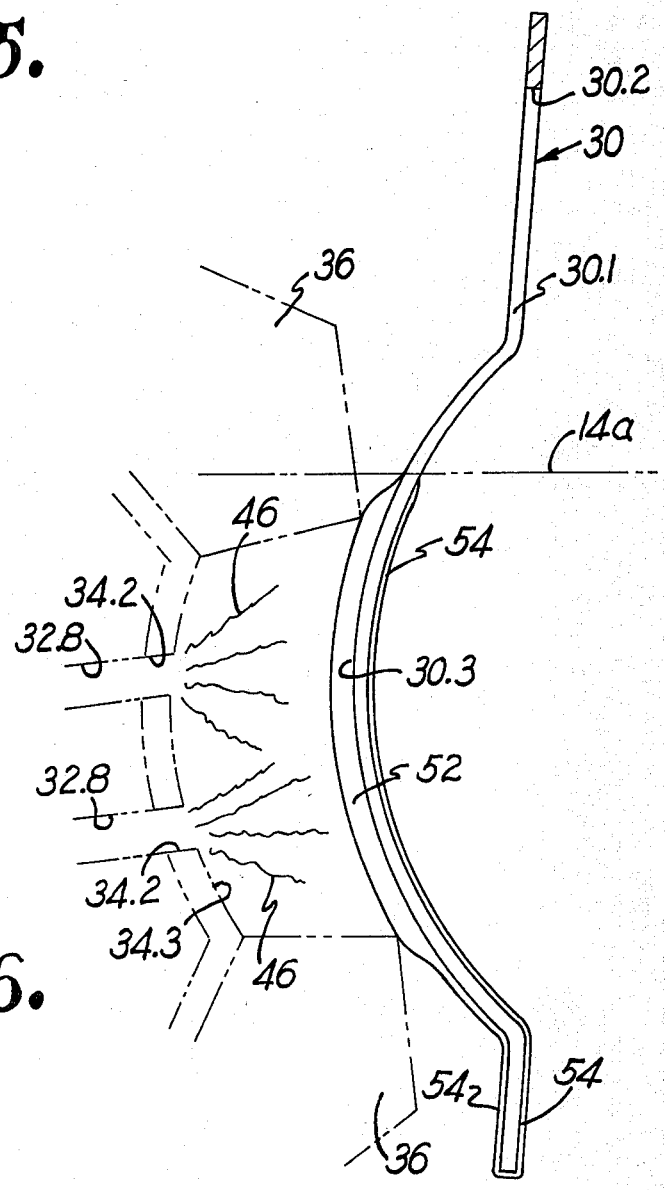
FIG. 6 is a partial section view to enlarged scale along line 6—6 of FIG. 5.

In the method of this invention, an electroplating solution is introduced into the container 12 via the inlet 12.3 and through the conduit 32 so that jets of the solution are directed into the bath 14 through the holes 32.8 and 34.2 in the conduit and anode. The work pieces 30, prepared for electroplating in any conventional manner as by degreasing and by preliminary full plating with a thin nickel strike or the like, are advanced through the bath in spaced sequential relation to each other as abovedescribed so that portions of the spaced contact members 30.1 are immersed in the bath and move in sliding engagement with the lands 36 on the conduit 32, thereby to pass selected laterally extending strips of the contact members (as indicated by the broken lines at 30.3 in FIG. 5) in closely spaced facing relation to the anode surface 34.3. The jets 46 of the electroplating solution directed through the openings 32.8 and 34.2 in the conduit and anode into the bath 14 provide a continuous positive flow of the electroplating solution in a direction from the anode surface 34.3 toward the strips 30.3 of the contact members to permit the flowing electroplating solution to flow against the strips 30.3 and to pass between the contact members 30.1 while the lands 36 restrict the flow of the electroplating solution in other directions. That is, directing of the jets 46 into the small space defined between the anode face 34.3, the strips 30.3 and the lands 36 below the surface level **14*a* of the bath provides a uniform flow of the electroplating solution against each of the contact member strips 30.3 as the strips are advanced along the length of the anode face 34.3. At the same time, a potential differences is established between the contact members and the anode surface 34.3 to direct an electrical current between the anode surface and the members through the flowing electroplating solution. In this arrangement, the close spacing of the anode surface to the member strips 30.3 and the uniform positive flow of electroplating solution from the anode surface to the strips in the small space cooperate to achieve substantially uniform plating of all portions of each of the strips 30.3 as the strips are advanced along the anode face. Where the anode face 34.3 has a configuration corresponding to that of the member strips as shown, so that each portion of each strip is advanced along the anode surface in the same spaced relation to corresponding portions of the anode face, even further uniformity of the plating of the strip 30.3 is achieved. This arrangement is particularly advantageous where the strip 30.3 of the article to be plated has a bowed, or other thin flat, surface configuration as is shown in FIG. 6. That is, the thickness of the plating deposited on each strip 30.3 between the lands 36 is highly uniform throughout all portions of the strip 30.3. Accordingly, the plating of the strips is controlled with small thickness tolerances by regulation of the applied potential, of the flow velocity and concentration of the electroplating solution, and of the speed of advance of the work pieces and the like in conventional manner with assurance that the plating formed on the strips 30.3 meets desired specifications. Some small thickness of plating does tend to be deposited on the contact members 30.1 outside the areas of the laterally extending strips 30.3 but because of the location of the lands 36 and the lesser current density between the anode surface 34.3 and those other portions of the contact members a relatively much lesser thickness of plating deposit is formed on those other surface areas. Further, the process is adapted for very fast operation so that the desired plating of the member strips 30.3** is achieved with very low manufacturing costs even where the article to be plated is of a bowed configuration as shown.

Typically for example, where the contact members 30.1 are formed of beryllium copper and are preliminarily plated over all of their surfaces with the thin nickel strike, a conventional acid-type cyanide gold plating solution is used in the bath 14 at a pH of 4.0, at a temperature of 165° F. (75° C.) and with a specific gravity of at least about 18° Baume; the solution having 4.0 troy ounces of gold per content per gallon. The work pieces 30 are then advanced at a speed of about 5 to 20 feet per minute along an anode 34 having a length of 40 inches while a potential of about 4.0 volts d.c. is applied between the anode and the work pieces to achieve a current density of about 80 to 150 amperes per square foot between the anode and work pieces. The electroplating solution is pumped into the conduit 32 at a rate of 40 gallons per minute to achieve a positive flow of electroplating solution from the anode face 34.3 toward the contact member strips 30.3 of about 5 gallons per minute. In this way each contact member is plated with gold of 99.0 percent or greater purity to a thickness of between 120 and 140 millionths of an inch as indicated at 52 in FIG. 6 while the other portions of the contact member immersed in the bath 14 are plated to a thickness of less than about 40 millionths of an inch as indicated at 54 in FIG. 6, the remaining areas of the contact members which are not immersed in the bath being free of any plating as will be understood. In this way, substantial selectivity of plating of the contact member is achieved with assurance that the necessary thickness of plating is achieved in the more narrowly restricted areas of the laterally extending strips 30.3 of the member. Thus the yield of the plating process is high and the process is rapidly carried out so that unit costs are kept low.

It should be understood that although preferred embodiments of the methods and apparatus of this invention have been described by way of illustrating the invention, the invention includes all modifications and equivalents of the described embodiments which fall within the scope of the appended claims.

What is claimed:

1. A method of rapidly electroplating selected portions of a plurality of metallic articles having a selected front surface configuration to be plated to enhance the uniformity of plating on said surfaces for permitting such selective plating in a commercially effective manner using lesser tolerances, the method comprising the steps of providing a reservoir of an electroplating solution with a top surface level of the solution in the reservoir defined, moving the selected portions of the articles through the reservoir beneath the top surface thereof in a straight longitudinal direction so that the selected front configuration of the articles define a plane area of selected length as the articles move through the reservoir, disposing an anode with a longitudinally extending surface essentially conforming to the plane area in the reservoir beneath the top surface of the reservoir closely adjacent to but spaced from said plane so that the space between the plane and the anode surface is maintained continuously filled with the plating solution of the reservoir, disposing parallel, longitudinally extending lands of electrically insulating material above and below the anode surface to cooperate with the anode and with said plane to form a plating cavity, the cavity being defined by the anode serving as a back portion of the cavity, by the lands serving as top and bottom portions of the cavity, and by a front portion defined by the selected front surface configurations of the articles moving past the anode the lands each forming an edge extending longitudinally along the plating cavity.

biasing the articles to slide against the edges formed by the lands as the articles move through the reservoir, directing jets of electroplating solution into the plating cavity in a direction extending from the anode toward the front portion of the plating cavity whereby the solution is caused to pass through the first portion of the cavity between adjacent articles moving along the front portion of the plating cavity, upward and downward flow of the solution being blocked by the edges of the respective lands, and directing electrical current through the plating solution between the anode and the articles moving past the anode.

* * * * *